US007101001B1

(12) United States Patent
Chiu

(10) Patent No.: US 7,101,001 B1
(45) Date of Patent: Sep. 5, 2006

(54) COUPLING DEVICE PREVENTING TWO DRAWERS FROM BEING PULLED OUT SIMULTANEOUSLY

(76) Inventor: I Hsiang Chiu, 11, Alley 52, Lane 413, Ying Tao Rd., Ying Ghor Town, Taipei County (TW)

( * ) Notice: Subject to any disclaimer, the term of this patent is extended or adjusted under 35 U.S.C. 154(b) by 0 days.

(21) Appl. No.: 11/150,537

(22) Filed: Jun. 13, 2005

(51) Int. Cl.
*E05C 7/06* (2006.01)

(52) U.S. Cl. ..... 312/221; 312/217

(58) Field of Classification Search ..... 312/216, 312/217, 218, 219, 220, 221, 222, 330.1, 312/107.5; 292/DIG. 18
See application file for complete search history.

(56) References Cited

U.S. PATENT DOCUMENTS 3,454,320 A * 7/1969 Olree ..... 312/217
6,238,024 B1 * 5/2001 Sawatzky ..... 312/221
6,296,332 B1 * 10/2001 Lammens ..... 312/217
6,568,771 B1 * 5/2003 Gentili et al. ..... 312/221
6,932,445 B1 * 8/2005 Chiu ..... 312/221
6,957,877 B1 * 10/2005 Chiu ..... 312/221

FOREIGN PATENT DOCUMENTS

CH 289618 * 3/1953 ..... 312/217

* cited by examiner

*Primary Examiner*—James O. Hansen
(74) *Attorney, Agent, or Firm*—Troxell Law Office, PLLC

(57) ABSTRACT

A coupling device preventing two drawers from being pulled out simultaneously includes two flat main bodies and a coupling pipe. Each of the main bodies is provided at two opposite ends with a centered vertical recess and a horizontal recess, respectively. The centered vertical recess is provided in an open end with two opposite curved flanges, and at a closed bottom end with a projected post. The coupling pipe has an axially centered through hole, into two ends of which the projected posts in the vertical recesses of the two main bodies are inserted, so that each end of the coupling pipe is clamped between the two flanges on each main body to enable a stable connection of the main body to the coupling pipe.

2 Claims, 6 Drawing Sheets

COUPLING DEVICE PREVENTING TWO DRAWERS FROM BEING PULLED OUT SIMULTANEOUSLY

FIELD OF THE INVENTION

The present invention relates to a coupling device preventing two drawers from being pulled out simultaneously, and more particularly to a coupling device that has simplified structure and can be easily assembled to effectively prevent two drawers from being pulled out simultaneously.

BACKGROUND OF THE INVENTION

A conventional coupling device preventing two drawers from being pulled out simultaneously, as shown in FIGS. 1 and 2, mainly includes a main body 10 connected to each end of a solid link 20 via a connecting element 30. The main body 10 is provided at two opposite ends with a receiving hole 101 and a horizontal recess 102, respectively. A clamping portion 103 providing a clamping slot 1031 is formed at each lateral side of the receiving hole 101; and an inward extended hook portion 104 is formed at the outer side of each clamping portion 103. Two offset guide channels 1021, 1022 are formed at front and rear side surfaces of the main body 10, respectively, to extend from the horizontal recess 102 to a middle section of the main body 10. The connecting element 30 is a substantially inverted U-shaped member having a centered through hole 301. Two inward extended middle clamping portions 302 are formed at two lateral lower sides of the through hole 301, and two sideward projections 303 with increased width and thickness are formed at two lateral ends of the connecting element 30. As can be seen from FIG. 2, the connecting element 30 is connected to the main body 10 through engagement of two arm portions at two lateral sides of the through hole 301 with the clamping slots 1031 of the clamping portions 103, and the sideward projections 303 with the hook portions 104. The solid link 20 is connected to the main body 10 and the connecting element 30 by extending an end of the link 20 through the through hole 301 on the connecting element 30 into the receiving hole 101 on the main body 10, such that the end of the link 20 is clamped between the two middle clamping portions 302. In this manner, each end of the link 20 has a main body 10 and a connecting element 30 connected thereto.

FIGS. 3 and 4 show the operation of the conventional coupling device of FIG. 2. The coupling device assembled from the main bodies 10, the connecting elements 30, and the link 20 is mounted between the rear ends of an upper and a lower sliding rail 4, 5. An upper and a lower drawer 41, 51 are slidably mounted on the upper and the lower sliding rail 4, 5, respectively, to move inward or outward. The upper and the lower drawer 41, 51 are provided at respective rear end of at least one sidewall with a guide slide 42, 52 each. The guide slides 42, 52 include a guide slot 421, 521 each, which has an open-end upper section 422, 522 and a closed-end lower section 423, 523.

A circular disk 43 having two curved guide slots 431 extended along an outer edge thereof is provided at each side of the rear end of the upper sliding rail 4, and a stopper 44 is laid between the two disks 43. Two ends of the stopper 44 are provided with a sideward protrusion 441 each, so that the sideward protrusions 441 extend into the curved guide slots 431 on the disks 43. Similarly, a circular disk 53 having two curved guide slots 531 extended along an outer edge thereof is provided at each side of the rear end of the lower sliding rail 5, and a stopper 54 is laid between the two disks 43. Two ends of the stopper 44 are provided with a sideward protrusion 541 each, so that the sideward protrusions 541 extend into the curved guide slots 531 on the disks 53.

When the lower drawer 51 mounted on the lower sliding rail 5 is pulled outward while the upper drawer 41 mounted on the upper sliding rail 4 is in a fully pushed-in position, the sideward protrusions 441 are guided by the guide slot 421 on the guide slide 42 to slide along the curved guide slots 431 to a lower location, such that the stopper 44 is in a horizontal position to fitly attach to a bottom of the horizontal recess 102 on the main body 10. Meanwhile, the sideward protrusions 541 are guided by the guide slot 521 on the guide slide 52 to slide along the curved guide slots 531 to an upper location, such that the stopper 54 is in a vertical position to press against a bottom of the horizontal recess 102 on the main body 10 at the other end of the link 20. Since the stopper 54 is pressed against the bottom of the horizontal recess 102, the main body 10 mounted on the rear end of the lower sliding rail 5 is prevented from being pushed downward. At this point, the stopper 44 is prevented from being turned, and the upper drawer 41 is in a locked state and could not be pulled out, as shown in FIG. 3. When the lower drawer 51 is pushed inward at this point, the sideward protrusions 541 are guided by the guide slot 521 on the guide slide 52 to slide along the curved guide slots 531 to a lower location, bringing the vertical stopper 54 into a horizontal position without pressing against the bottom of the horizontal recess 102 on the main body 10, so that the upper drawer 41 is released from the locked state. Reversely, when the upper drawer 41 is pulled outward, the lower drawer 51 is brought into a locked state, as shown in FIG. 4. With the above arrangements, the upper and the lower drawer 41, 51 may be effectively prevented from being pulled out simultaneously to cause any danger.

The conventional coupling device preventing two drawers from being pulled out simultaneously assembled from the main bodies 10, the link 20, and the connecting elements 30 includes a plurality of components that have different shapes and complicate structure and therefore require high R&D and management cost, which inevitably reduces the competing ability of the coupling device in the market. It is therefore tried by the inventor to develop an improved coupling device preventing two drawers from being pulled out simultaneously that has simplified structure to enable easy assembling and reduced manufacturing cost to overcome the problems existed in the conventional coupling device.

SUMMARY OF THE INVENTION

A primary object of the present invention is to provide an improved coupling device preventing two drawers from being pulled out simultaneously that has simplified structure to enable easy assembling and effectively reduced manufacturing cost thereof.

The coupling device according to the present invention includes two flat main bodies and a coupling pipe. Each of the main body is provided at two opposite ends with a centered vertical recess and a horizontal recess, respectively. The centered vertical recess is provided at a closed bottom end with a projected post. Two offset guide channels are located at two opposite side surfaces of the main body to vertically extend from the horizontal recess to a middle section of the main body. The coupling pipe has an axially centered through hole, two ends of which are inserted into the vertical recesses on the two main bodies to engage with the projected posts, enabling the main body to stably connect to the coupling pipe.

To enable an effectively enhanced strength at joints of different parts, the coupling device preventing two drawers from being pulled out simultaneously according to the present invention is further provided at two opposite inner walls of an open end of the vertical recess on each main body with a radially inward protruded curved flange each, so that each end of the coupling pipe is stably clamped between the two flanges.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
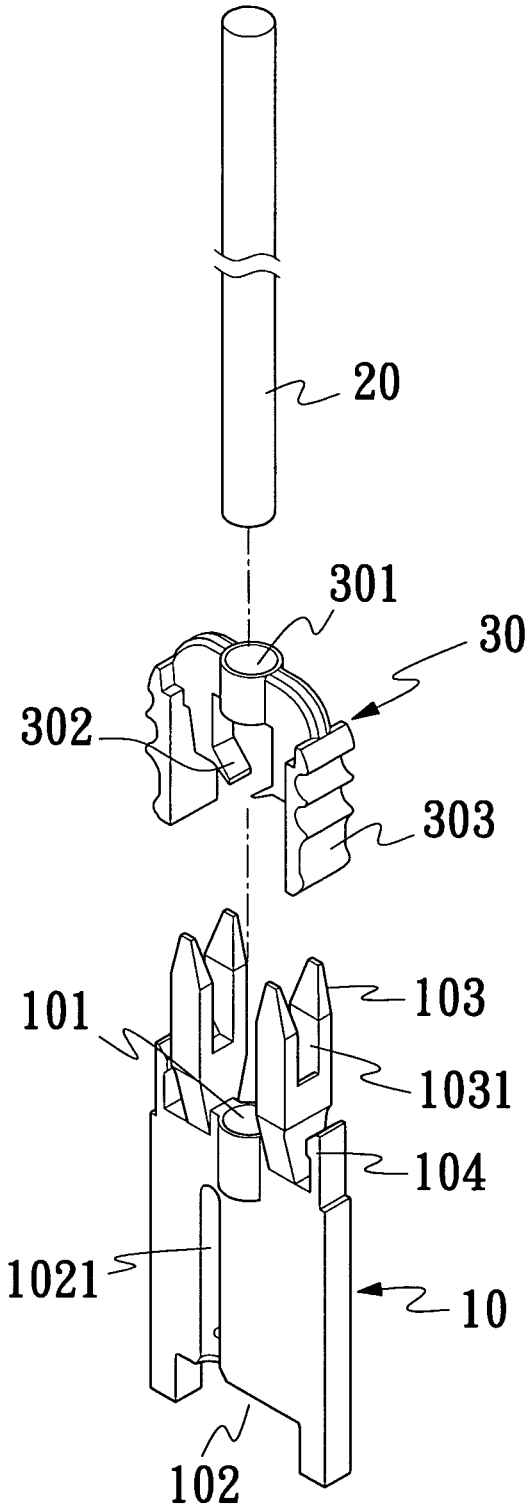
(PRIOR ART) Fig. 1
FIG. 1 is an exploded perspective view of a conventional coupling device preventing two drawers from being pulled out simultaneously.
Figure 2:
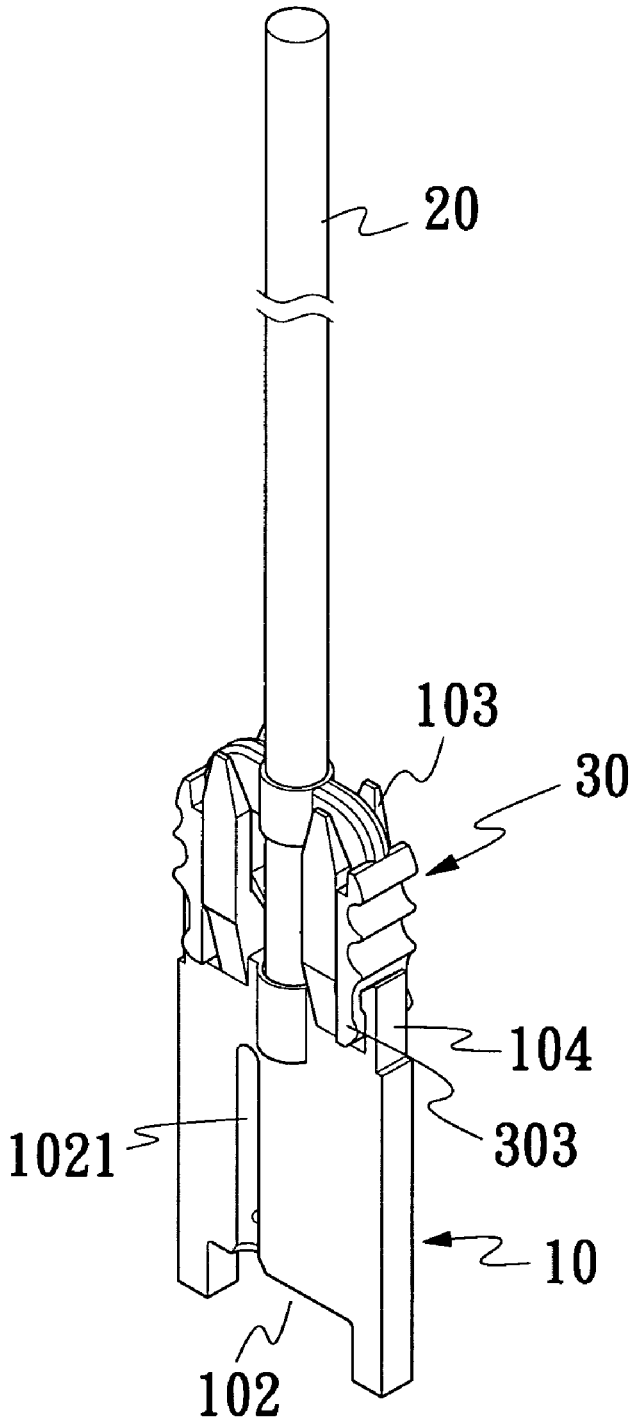
(PRIOR ART) Fig. 2
FIG. 2 is an assembled view of FIG. 1.
Figure 3:
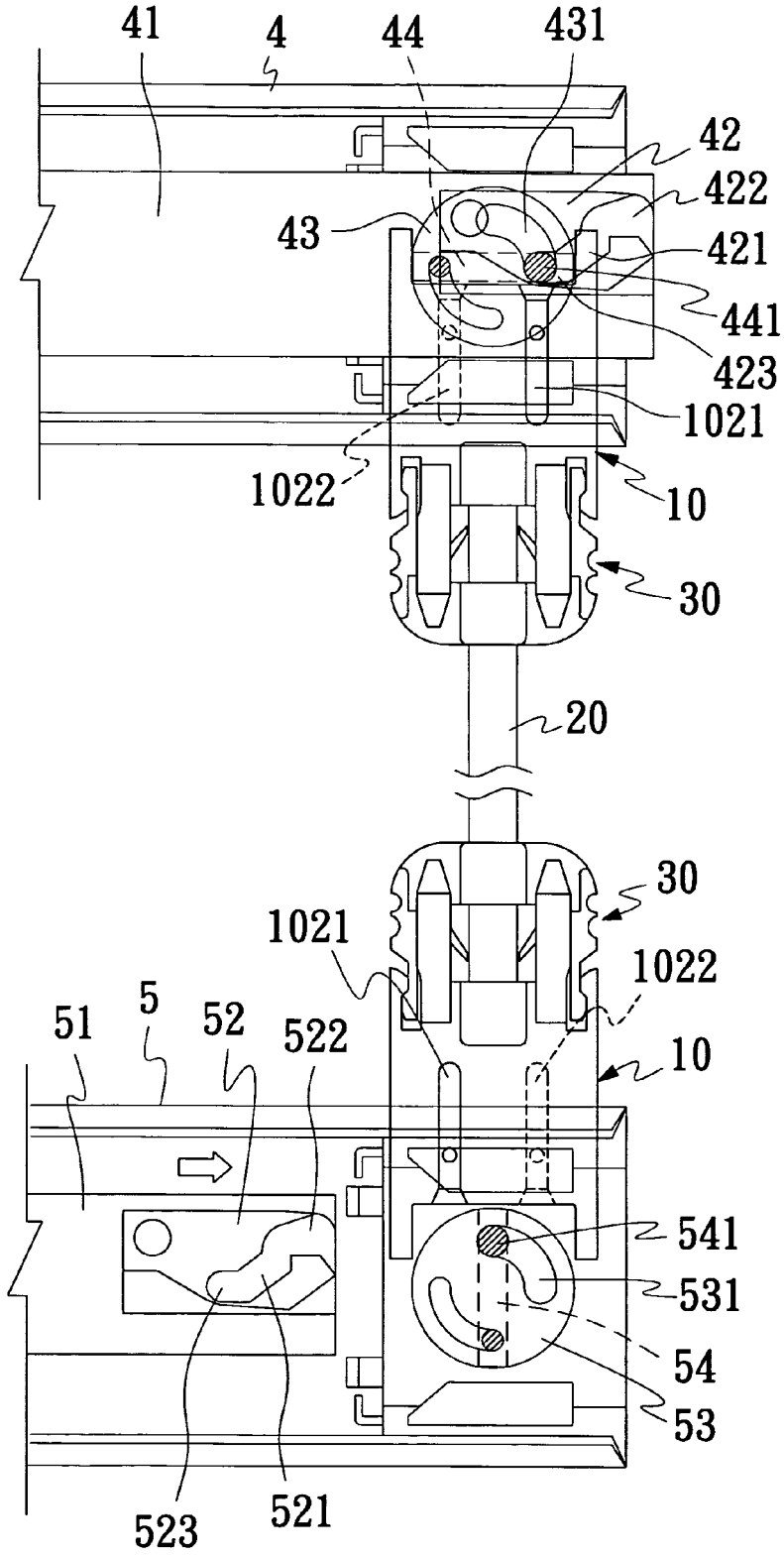
(PRIOR ART) Fig. 3
FIGS. 3 and 4 shows the operation of the coupling device of FIG. 2.
Figure 4:
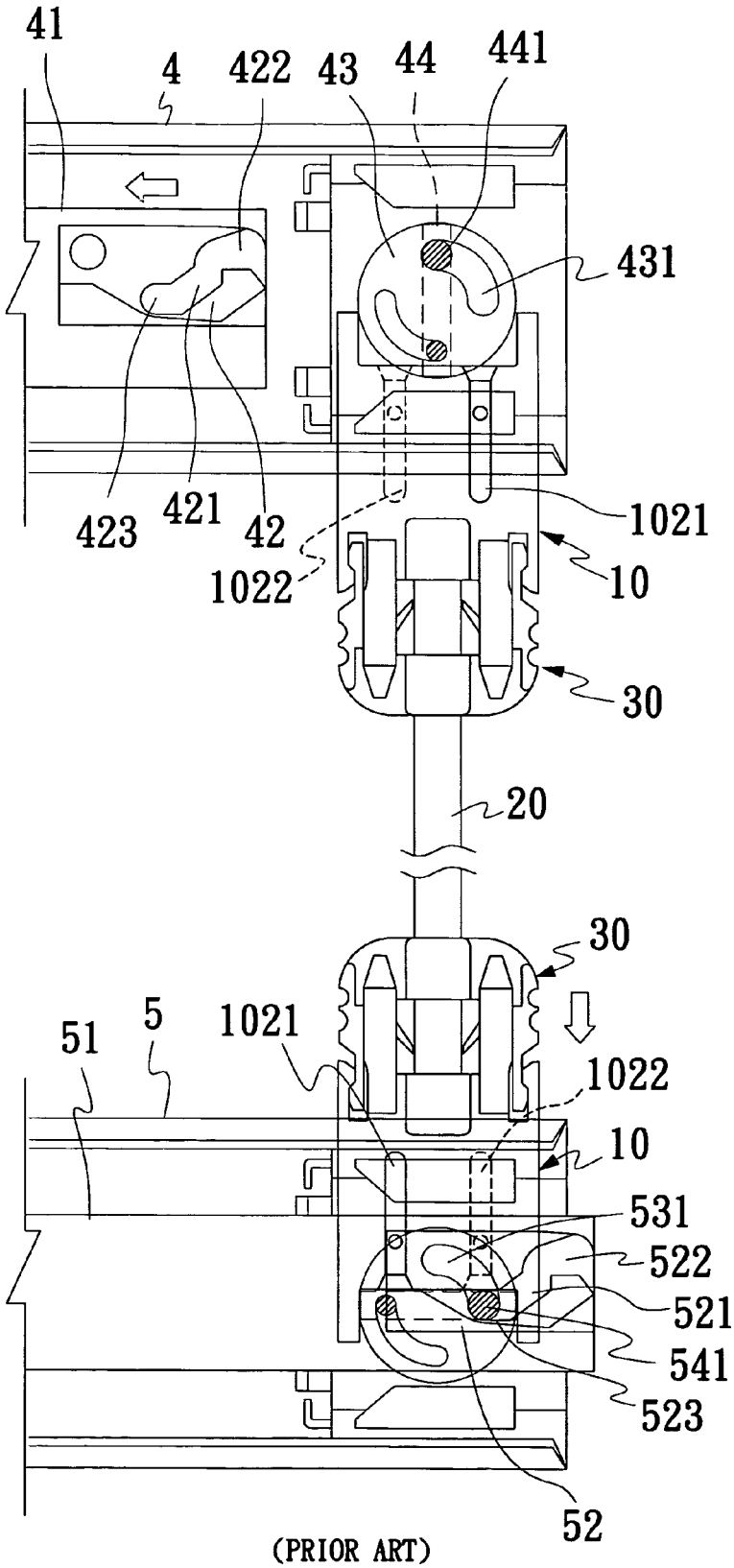
(PRIOR ART) Fig. 4
Figure 5:
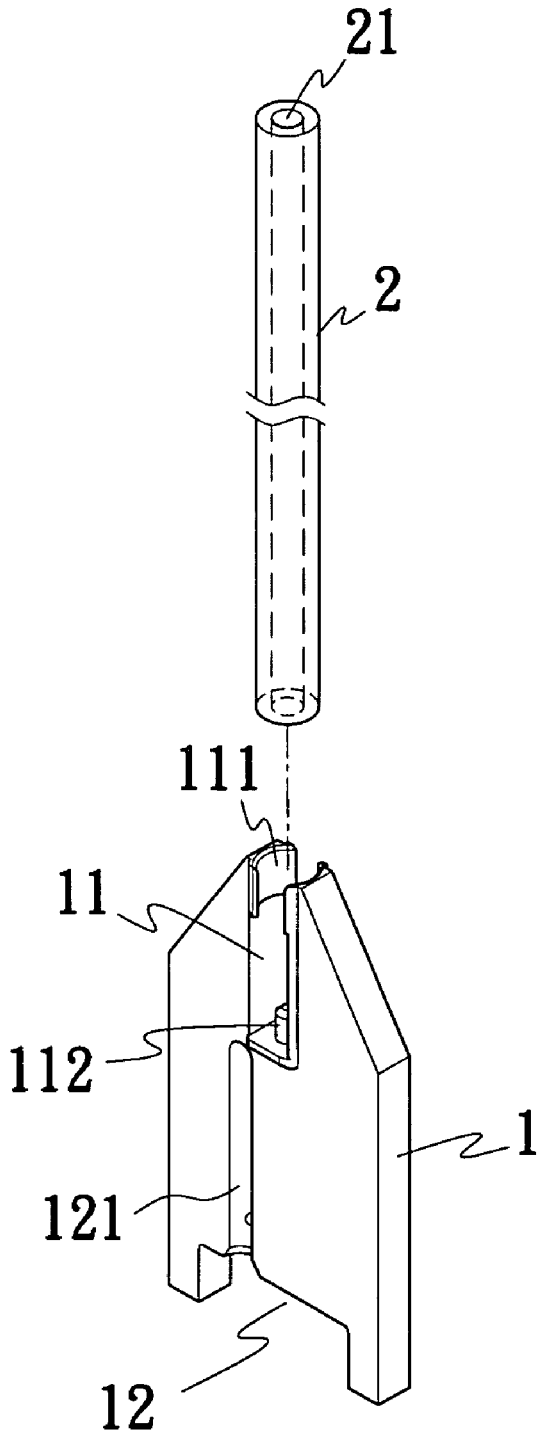
FIG. 5 is an exploded perspective view of a coupling device preventing two drawers from being pulled out simultaneously according to the present invention.
Figure 6:
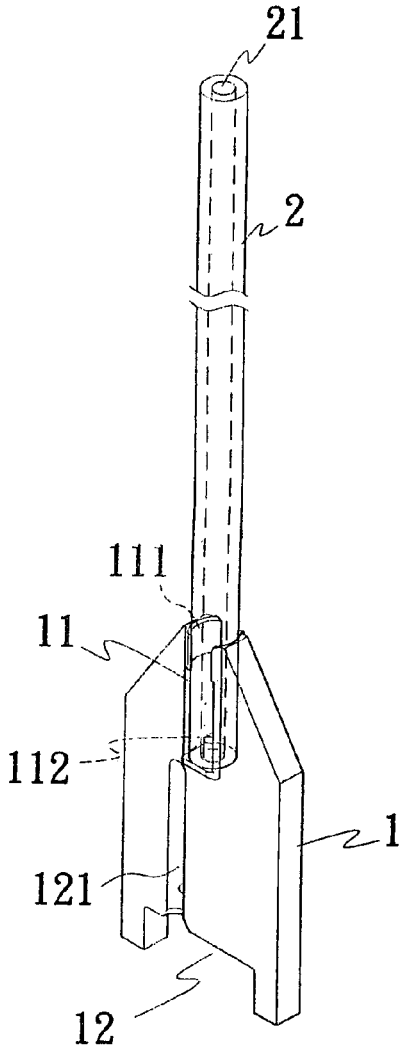
FIG. 6 is an assembled view of FIG. 5.
Figure 7:
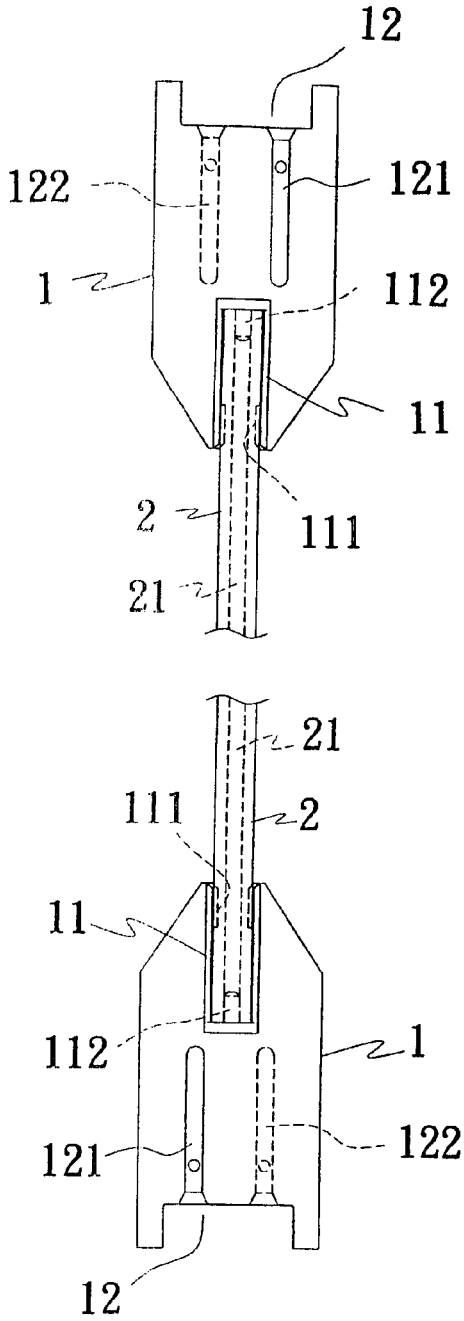
FIG. 7 is an assembled plan view of the present invention.

FIGS. 5–7 show a coupling device that includes two flat main bodies 1 assembled to two ends of a coupling pipe 2.

FIG. 5 shows an exploded perspective view of a coupling device preventing two drawers from being pulled out simultaneously according to the present invention.

Each main body 1 is provided at two opposite ends with a centered vertical recess 11 and a horizontal recess 12, respectively. The centered vertical recess 11 is provided at two opposite inner walls of an open end thereof with a radially inward protruded curved flange 111 each, and at a closed bottom end with a projected post 112. Two offset guide channels 121, 122 located at two opposite side surfaces of the main body 1 are vertically extended from the horizontal recess 12 to a middle section of the main body 1. The coupling pipe 2 has an axially centered through hole 21.

FIGS. 6 & 7 show assembled perspective and plan views, respectively, of the present invention. To assemble the coupling device, simply insert an end of the coupling pipe 2 fully into the vertical recess 11, and the coupling pipe 2 is clamped between the two curved flanges 111 with an opening of the through hole 21 at that end tightly engaged with the projected post 112 at the bottom of the vertical recess 11, enabling the main body 1 and the coupling pipe 2 to stably and firmly connect together. The other main body 1 may then be connected to the other end of the coupling pipe 2 in the same manner.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A coupling device preventing two drawers from being pulled out simultaneously, comprising:

two flat main bodies, each of the two flat main bodies being provided at two opposite ends with a centered vertical recess and a horizontal recess, respectively; said centered vertical recess includes a closed bottom end with a projected post extending upwardly from the closed bottom end, each of the two flat main bodies further including two offset guide channels being located at two opposite side surfaces that extend vertically from said horizontal recess to a middle section of said main bodies; and a coupling pipe having an axially centered through hole, each projected post being inserted into the through hole at opposite ends of the coupling pipe to ensure a tight fit, such that the two flat main bodies are stably connected to the coupling pipe.

2. The coupling device preventing two drawers from being pulled out simultaneously as claimed in claim 1, wherein said centered vertical recess is provided at two opposite inner walls of an open end thereof with a radially inward protruded curved flange each.

* * * * *